US009399366B2

(12) United States Patent
Hoffmuller et al.

(10) Patent No.: US 9,399,366 B2
(45) Date of Patent: Jul. 26, 2016

(54) SECURITY ELEMENT

(75) Inventors: Winfried Hoffmuller, Bad Tolz (DE); Marius Dichtl, Munich (DE); Manfred Heim, Bad Tolz (DE); Mario Keller, Munich (DE)

(73) Assignee: Giesecke & Devrient GMBH, Munich (DE)

( * ) Notice: Subject to any disclaimer, the term of this patent is extended or adjusted under 35 U.S.C. 154(b) by 313 days.

(21) Appl. No.: 12/999,685

(22) PCT Filed: Jun. 16, 2009

(86) PCT No.: PCT/EP2009/004326
§ 371 (c)(1),
(2), (4) Date: Dec. 17, 2010

(87) PCT Pub. No.: WO2009/156079
PCT Pub. Date: Dec. 30, 2009

(65) Prior Publication Data

US 2011/0109078 A1 May 12, 2011

(30) Foreign Application Priority Data

Jun. 23, 2008 (DE) ..... 10 2008 029 638

(51) Int. Cl.
*B42D 25/342* (2014.01)
*B42D 25/391* (2014.01)

(52) U.S. Cl.
CPC ..... *B42D 25/342* (2014.10); *B42D 25/391* (2014.10)

(58) Field of Classification Search
CPC .. B42D 25/342; B42D 25/364; B42D 25/373; B42D 25/391
USPC ..... 283/85, 87, 72, 90, 93
See application file for complete search history.

(56) References Cited

U.S. PATENT DOCUMENTS 1,475,430 A 11/1923 Curwen
5,712,731 A 1/1998 Drinkwater et al.
(Continued)

FOREIGN PATENT DOCUMENTS

DE 3602563 C1 4/1987
DE 19949542 A1 4/2001
(Continued)

OTHER PUBLICATIONS

Durand F., Photography—Reversible Prints, Integral Photographs, (English translation of article by Lippman), Academy of the Sciences, Mar. 2, 1908 session, 4 pages.
(Continued)

*Primary Examiner* — Matthew G Katcoff
(74) *Attorney, Agent, or Firm* — Lathrop & Gage LLP

(57) ABSTRACT

The present invention relates to a security element for security papers, value documents and the like, having a micro-optical moiré magnification arrangement having a first motif image that consists of a planar periodic or at least locally periodic arrangement of a plurality of first micromotif elements (38) that produce a hidden piece of image information, and a planar periodic or at least locally periodic arrangement of a plurality of microfocusing elements (34) for the moiré-magnified viewing of the first micromotif elements of the motif image, the first micromotif elements (38) being formed from nematic liquid crystal material and forming a phase-shifting layer for light from a specified wavelength range, and the magnified moiré image being perceptible substantially only upon viewing the security element through a polarizer.

20 Claims, 5 Drawing Sheets

(56) References Cited

U.S. PATENT DOCUMENTS

Figure 1:
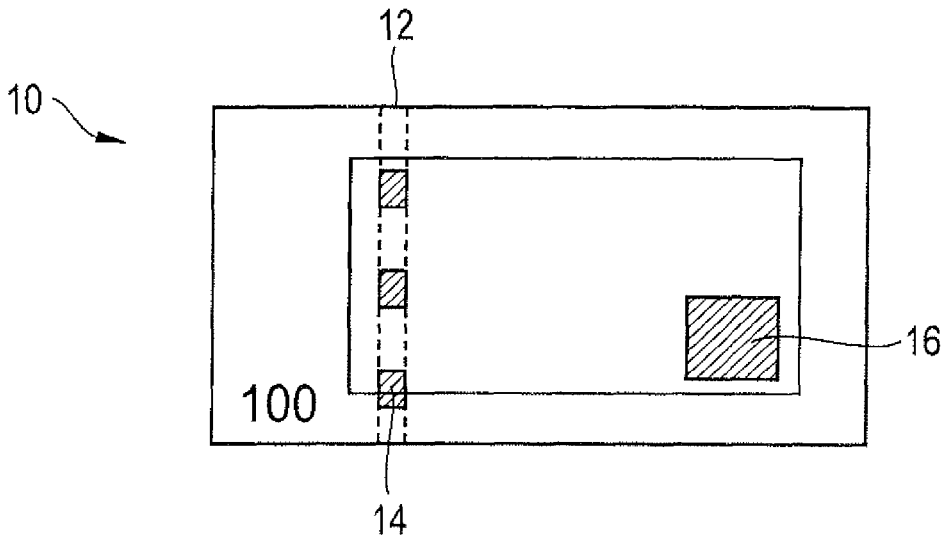

| | | | | |
|---|---|---|---|---|
| 5,723,200 | A | 3/1998 | Oshima et al. | |
| 5,772,250 | A | 6/1998 | Gasper | |
| 6,288,842 | B1 | 9/2001 | Florczak et al. | |
| 6,329,040 | B1 | 12/2001 | Oshima et al. | |
| 7,333,268 | B2 * | 2/2008 | Steenblik et al. | 359/619 |
| 7,667,894 | B2 | 2/2010 | Hoffmuller | |
| 7,728,931 | B2 | 6/2010 | Hoffmuller | |
| 7,808,605 | B2 | 10/2010 | Hoffmuller | |
| 7,986,459 | B2 | 7/2011 | Kaule | |
| 8,083,894 | B2 | 12/2011 | Gruszczynski | |
| 8,149,511 | B2 | 4/2012 | Kaule | |
| 2003/0035191 | A1 * | 2/2003 | Moia | 359/281 |
| 2006/0003295 | A1 | 1/2006 | Hersch et al. | |
| 2007/0177131 | A1 | 8/2007 | Hansen | |
| 2007/0211238 | A1 | 9/2007 | Hoffmuller | |
| 2007/0216518 | A1 * | 9/2007 | Hoffmuller | G07D 7/122 340/5.85 |
| 2007/0229263 | A1 | 10/2007 | Staub et al. | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0037131 | A1 | 2/2008 | Steenblik et al. | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule et al. | |
| 2008/0163994 | A1 | 7/2008 | Hoppe | |
| 2008/0182084 | A1 | 7/2008 | Tompkin et al. | |
| 2008/0216976 | A1 | 9/2008 | Ruck | |
| 2008/0250954 | A1 | 10/2008 | Depta | |
| 2008/0258456 | A1 | 10/2008 | Rahm | |
| 2008/0259416 | A1 | 10/2008 | Peters et al. | |
| 2009/0001709 | A1 | 1/2009 | Kretschmar | |
| 2009/0008923 | A1 | 1/2009 | Kaule et al. | |
| 2009/0008926 | A1 | 1/2009 | Depta | |
| 2009/0102605 | A1 | 4/2009 | Kaule | |
| 2009/0115185 | A1 | 5/2009 | Hoffmuller | |
| 2009/0218397 | A1 | 9/2009 | Wild et al. | |
| 2009/0290221 | A1 | 11/2009 | Hansen et al. | |
| 2009/0297805 | A1 | 12/2009 | Dichtl | |
| 2009/0322071 | A1 | 12/2009 | Dichtl | |
| 2010/0175843 | A1 | 7/2010 | Gregarek | |
| 2010/0177094 | A1 | 7/2010 | Kaule | |
| 2010/0182221 | A1 | 7/2010 | Kaule et al. | |
| 2010/0194091 | A1 | 8/2010 | Heim | |
| 2010/0194532 | A1 | 8/2010 | Kaule et al. | |
| 2010/0196587 | A1 | 8/2010 | Keller | |
| 2010/0207376 | A1 | 8/2010 | Heim | |
| 2010/0208036 | A1 | 8/2010 | Kaule | |
| 2010/0307705 | A1 | 12/2010 | Rahm | |
| 2010/0308570 | A1 | 12/2010 | Heim | |
| 2010/0320742 | A1 | 12/2010 | Hoffmuller | |
| 2011/0000737 | A1 | 1/2011 | Nagase | |
| 2011/0012337 | A1 | 1/2011 | Heim | |
| 2011/0027538 | A1 | 2/2011 | Hoffmann | |
| 2011/0045248 | A1 | 2/2011 | Hoffmuller et al. | |
| 2011/0069360 | A1 | 3/2011 | Dichtl | |
| 2011/0079997 | A1 | 4/2011 | Heim | |
| 2011/0091665 | A1 | 4/2011 | Heim | |
| 2011/0095518 | A1 | 4/2011 | Hoffmuller | |
| 2011/0101670 | A1 | 5/2011 | Heim | |
| 2011/0109078 | A1 | 5/2011 | Hoffmuller | |
| 2011/0114733 | A1 | 5/2011 | Heim | |
| 2011/0157183 | A1 | 6/2011 | Kaule | |
| 2012/0126525 | A1 | 5/2012 | Dorfler | |
| 2012/0168515 | A1 | 7/2012 | Schutzmann | |
| 2012/0170124 | A1 | 7/2012 | Fuhse | |

FOREIGN PATENT DOCUMENTS

| | | | |
|---|---|---|---|
| DE | 102004007379 | B3 | 9/2005 |
| DE | 102004031879 | A1 | 1/2006 |
| DE | 102004059798 | A1 | 6/2006 |
| DE | 102005028162 | A1 | 12/2006 |
| DE | 102005052562 | A1 | 5/2007 |
| DE | 102005062132 | A1 | 7/2007 |
| DE | 102006006501 | A1 | 8/2007 |
| DE | 102006029536 | A1 | 12/2007 |
| DE | 102006029850 | A1 | 1/2008 |
| DE | 102007029203 | A1 | 1/2009 |
| DE | 102007062089 | A1 | 7/2009 |
| EP | 0064067 | A1 | 11/1982 |
| EP | 0238043 | A2 | 9/1987 |
| EP | 0330733 | A1 | 9/1989 |
| EP | 1554700 | B1 | 1/2007 |
| EP | 1953002 | A2 | 1/2008 |
| GB | 2362493 | A | 11/2001 |
| JP | 10035083 | A | 2/1998 |
| JP | 2001 055000 | A | 2/2001 |
| JP | 2003 039583 | A | 3/2003 |
| JP | 2003 120500 | A | 4/2003 |
| WO | WO 94/27254 | A1 | 11/1994 |
| WO | WO 99/13157 | A1 | 3/1999 |
| WO | WO 03/005075 | A1 | 1/2003 |
| WO | WO 2005/052650 | A2 | 6/2005 |
| WO | WO 2005/106601 | A2 | 11/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006/029745 | A1 | 3/2006 |
| WO | WO 2006040069 | | 4/2006 |
| WO | WO 2006056342 | | 6/2006 |
| WO | WO 2006072380 | | 7/2006 |
| WO | WO 2006/087138 | A1 | 8/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007/007793 | A1 | 1/2007 |
| WO | WO 2007006445 | | 1/2007 |
| WO | WO 2007006455 | | 1/2007 |
| WO | WO 2007/030530 | A2 | 3/2007 |
| WO | WO 2007/076952 | A2 | 7/2007 |
| WO | WO 2007076952 | | 7/2007 |
| WO | WO 2007079851 | | 7/2007 |
| WO | WO 2007/087984 | A1 | 8/2007 |
| WO | WO 2007115648 | | 10/2007 |
| WO | WO 2007/131765 | A2 | 11/2007 |
| WO | WO 2008/000350 | | 1/2008 |
| WO | WO 2008/000350 | A1 | 1/2008 |
| WO | WO 2008/000351 | | 1/2008 |
| WO | WO 2008/000351 | A2 | 1/2008 |
| WO | WO 2008/049533 | | 5/2008 |
| WO | WO 2008/061636 | | 5/2008 |
| WO | WO 2008/071325 | | 6/2008 |
| WO | WO 2009/000527 | | 12/2008 |
| WO | WO 2009/000528 | | 12/2008 |
| WO | WO 2009/000528 | A1 | 12/2008 |
| WO | WO 2009/000529 | | 12/2008 |
| WO | WO 2009/000529 | A2 | 12/2008 |
| WO | WO 2009/000530 | | 12/2008 |
| WO | WO 2009/012893 | | 1/2009 |
| WO | WO 2009/024265 | | 2/2009 |
| WO | WO 2009/080262 | | 7/2009 |
| WO | WO 2009/080263 | | 7/2009 |
| WO | WO 2009/083146 | | 7/2009 |
| WO | WO 2009/083151 | | 7/2009 |
| WO | WO 2009/100831 | | 8/2009 |
| WO | WO 2009/100869 | | 8/2009 |
| WO | WO 2009/109291 | | 9/2009 |
| WO | WO 2009/121578 | | 10/2009 |
| WO | WO 2009/149831 | | 12/2009 |
| WO | WO 2009/149833 | | 12/2009 |
| WO | WO 2009/156079 | | 12/2009 |
| WO | WO 2010/000470 | | 1/2010 |

(56) References Cited

FOREIGN PATENT DOCUMENTS

| | | |
|---|---|---|
| WO | WO 2010/003646 | 1/2010 |
| WO | WO 2010/028739 | 3/2010 |
| WO | WO 2011/012281 | 2/2011 |
| WO | WO 2011/032665 | 3/2011 |
| WO | WO 2011/032671 | 3/2011 |

OTHER PUBLICATIONS

German Search Report, German Patent Application No. DE 102007029204, Aug. 21, 2007, 4 pages.
German Search Report, German Patent Application No. DE 102007029203, Aug. 23, 2007, 4 pages.
Hutley M.C. et al., The moiré magnifier, Pure Appl. Opt. 3:133-142, 1994.
Kamal H. et al., Properties of moiré magnifiers, Optical Engineering 37(11):3007-3014, Nov. 1998.
International Search Report, International Application No. PCT/EP2008/005173, Dec. 15, 2008, 3 pages.
International Preliminary Report on Patentability, International Application No. PCT/EP2008/005173, Corrected Version, English Translation, Mar. 22, 2010, 6 pages.
International Search Report, International Application No. PCT/EP2008/005172, Nov. 21, 2008, 2 pages.
International Preliminary Report on Patentability, International Application No. PCT/EP2008/005172, English Translation, Apr. 1, 2010, 5 pages.
International Search Report, International Application No. PCT/EP2008/005174, Feb. 16, 2009, 3 pages.
International Preliminary Report on Patentability, International Application No. PCT/EP2008/005174, English Translation, Mar. 1, 2010, 7 pages.
International Search Report, International Application No. PCT/EP2008/005171, Nov. 21, 2008, 2 pages.
International Preliminary Report on Patentability, International Application No. PCT/EP2008/005171, English Translation, Mar. 29, 2010, 4 pages.
International Search Report, International Application No. PCT/EP2009/004326, Oct. 19, 2009, 3 pages.
International Preliminary Report on Patentability, International Application No. PCT/EP2009/004326, English Translation, Mar. 22, 2011, 5 pages.
International Search Report, International Application No. PCT/EP2009/005987, Jan. 27, 2010, 3 pages.
International Preliminary Report on Patentability, International Application No. PCT/EP2009/005987, English Translation, May 4, 2011, 5 pages.
Rahm, Michael, Modulo mapping—Novel Method to Arrange Microstructures for Moiré Magnifier Type Security Features, Abstract, Session 5: Optically Variable Security I, Jan. 22, 2010, Optical Document Security II, The 2010 Conference on Optical Security and Counterfeit Deterrence, Jan. 20-22, 2010, San Francisco, p. 1-5.
Rauscher W. et al., Novel method to arrange microstructures for moiré magnifier type security features, Optical Document Security II, San Francisco, Jan. 20-22, 2010, pp. 1-11.
U.S. Appl. No. 11/568,302, filed Oct. 25, 2006, Hoffmuller, 2007-0216518, WO 2005/105474.
U.S. Appl. No. 11/568,386, filed Oct. 26, 2006, Hoffmuller, 2007-0229928, WO 2005/105473.
U.S. Appl. No. 11/568,388, filed Oct. 26, 2006, Hoffmuller, 2007-0211238, WO 2005/108108.
U.S. Appl. No. 11/568,390, filed Oct. 26, 2006, Hoffmuller, 2007-0165182, WO 2005/105475.
U.S. Appl. No. 11/568,535, filed Nov. 12, 2007, Depta, 2008-0088859, WO 2005108106.
U.S. Appl. No. 11/568,538, filed Sep. 23, 2008, Depta, 2009-0008926, WO 2005/108110.
U.S. Appl. No. 11/571,923, filed Jan. 10, 2007, Hoffmuller, 2008-0014378, WO 2006/005434.
U.S. Appl. No. 11/573,060, filed Feb. 1, 2007, Depta, 2007-0274559, WO 2006/015733.
U.S. Appl. No. 11/573,484, filed Feb. 9, 2007, Heim, 2007-0246933, WO 2006/018171.
U.S. Appl. No. 11/573,506, filed Feb. 9, 2007, Burchard, 2008-0054621, WO 2006/018172.
U.S. Appl. No. 11/576,583, filed Apr. 3, 2007, Heim, 2007-0241553, WO 2006040069.
U.S. Appl. No. 11/719,843, filed Apr. 3, 2008, Kaule, 2009-0102605, WO 2006/056342.
U.S. Appl. No. 11/813,077, filed Jun. 28, 2007, Hoppe, 2008-0163994, WO 2006/072380.
U.S. Appl. No. 11/779,707, filed Jul. 18, 2007, Fessl, 2008-0079257, n/a.
U.S. Appl. No. 11/816,514, filed Aug. 16, 2007, Kaule, 2008-0160226, WO 2006/087138.
U.S. Appl. No. 11/909,115, filed Sep. 19, 2007, Kretschmar, 2009-0001709, WO 2006/099971.
U.S. Appl. No. 11/913,658, filed May 14, 2008, Ruck, 2008-0216976, WO 2006/119896.
U.S. Appl. No. 11/915,965, filed Nov. 29, 2007, Depta, 2008-0250954, WO 2006/128607.
U.S. Appl. No. 11/995,227, filed Jan. 10, 2008, Gruszczynski, 2009-0236061, WO 2007/006445.
U.S. Appl. No. 11/995,228, filed Jan. 10, 2008, Kaule, 2008-0198468, WO 2007/006455.
U.S. Appl. No. 12/097,668, filed Jun. 16, 2008, Rahm, 2008-0258456, WO 2007/079851.
U.S. Appl. No. 12/097,834, filed Jun. 17, 2008, Kaule, 2009-0008923, WO 2007/076952.
U.S. Appl. No. 12/294,222, filed Sep. 23, 2008, Hoffmuller, 2009-0115185, WO 2007/115648.
U.S. Appl. No. 12/304,498, filed Dec. 12, 2008, Dichtl, 2009-0297805, WO 2008/000350.
U.S. Appl. No. 12/304,522, filed Dec. 12, 2008, Dichtl, 2009-0322071, WO 2008/000351.
U.S. Appl. No. 12/446,494, filed Apr. 21, 2009, Heim, 2010-0194091, WO 2008/049533.
U.S. Appl. No. 12/515,923, filed May 21, 2009, Heim, 2010-0207376, WO 2008/061636.
U.S. Appl. No. 12/517,848, filed Jun. 8, 2010 Gregarek, 2010-0175843, WO 2008/071325.
U.S. Appl. No. 12/665,072, filed Dec. 17, 2009, Kaule, 2010-0194532, WO 2009/000529.
U.S. Appl. No. 12/665,078, filed Dec. 17, 2009, Kaule, 2010-0182221, WO 2009/000528.
U.S. Appl. No. 12/665,834, filed Dec. 21, 2009, Kaule, 2010 0208036, WO 2009/000530.
U.S. Appl. No. 12/665,843, filed Dec. 21, 2009, Kaule, 2010-0177094, WO 2009/000527.
U.S. Appl. No. 12/669,838, filed Jan. 20, 2010, Keller, 2010-0196587, WO 2009/012893.
U.S. Appl. No. 12/673,805, filed Feb. 17, 2010, Dichtl, 2011-0069360, WO 2009/024265.
U.S. Appl. No. 12/808,733, filed Jun. 17, 2010, Heim, 2010-0308570, WO 2009/080263.
U.S. Appl. No. 12/809,002, filed Jun. 17, 2010, Heim, 2011-0079997, WO 2009/080262.
U.S. Appl. No. 12/809,334, filed Jun. 18, 2010, Rahm, 2010-0307705, WO 2009/083151.
U.S. Appl. No. 12/809,909, filed Jun. 21, 2010, Hoffmuller, 2011-0045248, WO 2009/083146.
U.S. Appl. No. 12/865,461, filed Aug. 12, 2010, Hoffmuller, 2010-0320742, WO 2009/100869.
U.S. Appl. No. 12/865,474, filed Aug. 15, 2010, Heim, 2011-0000737, WO 2009/100831.
U.S. Appl. No. 12/920,764, filed Sep. 9, 2010, Heim, 2011-0012337, WO 2009/109291.
U.S. Appl. No. 12/935,320, filed Oct. 2, 2010, Hoffmann, 2011-0027538, WO 2009/121578.

(56) References Cited

OTHER PUBLICATIONS

U.S. Appl. No. 12/997,130, filed Dec. 9, 2010, Heim, 2011-0091665, WO 2009/149833.
U.S. Appl. No. 12/997,323, filed Dec. 10, 2010, Heim, 2011-0101670, WO 2009/149831.
U.S. Appl. No. 12/999,685, filed Dec. 17, 2010, Hoffmuller, 2011-0109078, WO 2009/156079.
U.S. Appl. No. 13/002,117, filed Dec. 30, 2010, Hoffmuller, 2011-0095518, WO 2010/000470.
U.S. Appl. No. 13/002,861, filed Jan. 6, 2011, Heim, 2011-0114733, WO 2010/003646.
U.S. Appl. No. 13/062,991, filed Mar. 9, 2011, Kaule, 2011-0157183, WO 2010/028739.
U.S. Appl. No. 13/387,437, filed Jan. 27, 2012, Dorfler, 2012-0126525, WO 2011/012281.
U.S. Appl. No. 13/395,333, filed Mar. 9, 2012, Fuhse, 2012-0170124, WO 2011/032665.
U.S. Appl. No. 13/496,552, filed Mar. 16, 2012, Schutzmann, 2012-0168515, WO 2011/032671.
Lippmann M. G., Epreuves reversibles—Reversible Prints, Integral Photographs, Academy of the Sciences, Mar. 2, 1908 session, English translation by Fredo Durand, 4 pages.

* cited by examiner

SECURITY ELEMENT

CROSS-REFERENCE TO RELATED APPLICATIONS

This application is the U. S. National Stage of International Application No. PCT/EP2009/004326, filed Jun. 16, 2009, which claims the benefit of German Patent Application DE 10 2008 029 638.4, filed Jun. 23, 2008; both of which are hereby incorporated by reference to the extent not inconsistent with the disclosure herewith.

The present invention relates to a security element for security papers, value documents and the like, and especially relates to such a security element having a micro-optical moiré magnification arrangement. The present invention further relates to a method for manufacturing such a security element, a security paper and a data carrier having such a security element.

For protection, data carriers, such as value or identification documents, but also other valuable articles, such as branded articles, are often provided with security elements that permit the authenticity of the data carrier to be verified, and that simultaneously serve as protection against unauthorized reproduction. The security elements can be developed, for example, in the form of a security thread embedded in a banknote, a cover foil for a banknote having a hole, an applied security strip or a self-supporting transfer element that, after its manufacture, is applied to a value document.

Here, security elements having optically variable elements that, at different viewing angles, convey to the viewer a different image impression play a special role, since these cannot be reproduced even with top-quality color copiers. For this, the security elements can be furnished with security features in the form of diffraction-optically effective micro- or nanopatterns, such as with conventional embossed holograms or other hologram-like diffraction patterns, as are described, for example, in publications EP 0 330 733 A1 and EP 0 064 067 A1.

It is also known to use lens systems as security features. For example, in publication EP 0 238 043 A2 is described a security thread composed of a transparent material on whose surface a grid composed of multiple parallel cylindrical lenses is embossed. Here, the thickness of the security thread is chosen such that it corresponds approximately to the focal length of the cylindrical lenses. On the opposing surface, a printed image is applied in perfect register, the printed image being designed taking into account the optical properties of the cylindrical lenses. Due to the focusing effect of the cylindrical lenses and the position of the printed image in the focal plane, depending on the viewing angle, different sub-areas of the printed image are visible. In this way, through appropriate design of the printed image, pieces of information can be introduced that are visible only from certain viewing angles. Through a certain execution of the printed image, also "moving" pictures can, indeed, be created. However, when the document is turned about an axis that runs parallel to the cylindrical lenses, the motif moves only approximately continuously from one location on the security thread to another location.

Also micro-optical patterns, such as blazed grating patterns, microlens patterns, Fresnel-lens-like patterns or so-called moiré magnification arrangements have for some time been in use as security features. The fundamental operating principle of such moiré magnification arrangements is described in the article "The moiré magnifier," M. C. Hutley, R. Hunt, R. F. Stevens and P. Savander, Pure Appl. Opt. 3 (1994), pp. 133-142. In short, according to this article, moiré magnification refers to a phenomenon that occurs when a grid comprised of identical image objects is viewed through a lens grid having approximately the same grid dimension. As with every pair of similar grids, a moiré pattern results that, in this case, appears as a magnified and, if applicable, rotated image of the repeated elements of the image grid.

The manufacture of the image object grid is done in known moiré magnification arrangements with classic printing technologies or also by means of embossing technologies having various processing steps. However, both printing and suitable embossing technologies are now generally available on the market, such that such moiré magnification arrangements can be reproduced relatively easily by counterfeiters. Based on that, the object of the present invention is to avoid the disadvantages of the background art and especially to specify a security element having a micro-optical moiré magnification arrangement having high counterfeit security.

This object is solved by the security element having the features of the main claim. A method for manufacturing such a security element, a security paper and a data carrier having such a security element are specified in the coordinated claims. Developments of the present invention are the subject of the dependent claims.

According to the present invention, a generic security element includes a microoptical moiré magnification arrangement having

- a first motif image that consists of a planar periodic or at least locally periodic arrangement of a plurality of first micromotif elements that produce a hidden piece of image information, and
- a planar periodic or at least locally periodic arrangement of a plurality of microfocusing elements for the moiré-magnified viewing of the first micromotif elements of the first motif image, the first micromotif elements being formed from nematic liquid crystal material and forming a phase-shifting layer for light from a specified wavelength range, and the magnified moiré image being perceptible substantially only upon viewing the security element through a polarizer.

The chosen formulation, according to which the magnified moiré image is perceptible substantially only when the security element is viewed through a polarizer, accounts here for the fact that the motif image stands out in clear contrast only when a polarizer is used, but is hardly or not at all perceptible by the naked eye. The typical optical appearance of the moiré magnification arrangement thus permits observation only when additional auxiliary means are used and thus forms a hidden security feature that is integrated into the security element.

In an advantageous variant of the present invention, the first micromotif elements are formed by a nematic liquid crystal material layer thickness that is different in some regions. For example, the degree of the phase rotation can be proportional to the layer thickness, such that the influencing of the polarized light can be systematically adjusted via the layer thickness.

The nematic liquid crystal material can also be present only in some regions and in the form of the first micromotif elements. This design constitutes an extreme case of the embodiment just cited if the gap regions of the nematic liquid crystal material are understood as a layer having a layer thickness of zero.

In a preferred embodiment of the present invention, the first micromotif elements form, at least in sub-regions, a $\lambda/4$ layer for light from the specified wavelength range. Especially in this embodiment, the security element advantageously includes a metallic reflector. The metallic reflector can be formed, for example, by a layer composed of aluminum, copper, silver, chrome or a metal pigment layer.

In another, likewise preferred embodiment of the present invention, the first micromotif elements form, at least in subregions, a λ/2 layer for light from the specified wavelength range. Especially in this embodiment, the security element advantageously includes a linear polarizer. Alternatively or additionally, one or more layers composed of cholesteric liquid crystal material can be provided.

In all designs, a further nematic liquid crystal material that additionally exhibits a fluorescence functionality can be added to the nematic liquid crystal material. Alternatively, the nematic liquid crystal material itself can also be furnished with these properties. Such a liquid crystal material displays, when irradiated with light of a suitable wavelength and polarization, a defined fluorescence that is likewise polarized.

To further increase the counterfeit security, the first micromotif elements, which produce the hidden piece of image information, can be combined with at least one further motif image that consists of a planar periodic or at least locally periodic arrangement of a plurality of second micromotif elements that produce a visible piece of image information. Here, the magnified moiré image of these second micromotif elements is already perceptible without the used of auxiliary means when viewed with the naked eye. Accordingly, the security element displays a different appearance in each case when viewed with white light/without auxiliary means and when viewed through a polarizer. As explained in detail below, it is possible to produce also further, completely novel optical effects with such an embodiment. In particular, the first and the second micromotif elements can also form moiré images that are associated in meaning.

In a preferred embodiment of the present invention, the arrangement of first micromotif elements, the arrangement of microfocusing elements and, if applicable, the arrangement of second micromotif elements each form, at least locally, a two-dimensional Bravais lattice, the arrangement of first micromotif elements and/or the arrangement of microfocusing elements and/or the arrangement of second micromotif elements preferably forming a Bravais lattice having the symmetry of a parallelogram grating.

In an advantageous variant of the present invention, the arrangement of first micromotif elements and the arrangement of second micromotif elements are identical in their grating periods and grating orientations, each lattice site of the arrangement of first micromotif elements being occupied with a first micromotif element and/or a second micromotif element.

The first and the second micromotif elements are preferably arranged alternatingly. Each lattice site is thus occupied by a first micromotif element or a second micromotif element. According to an alternative embodiment, each lattice site can also be occupied with a first micromotif element and a second micromotif element, the first and second micromotif elements being, at least in part, present next to each other.

In a likewise advantageous variant of the present invention, the arrangement of first micromotif elements and the arrangement of second micromotif elements differ in their grating periods and/or grating orientations.

According to a preferred development of the present invention, the arrangement of first micromotif elements and the arrangement of second micromotif elements are arranged in different layers and can be present separated from one another by, for example, additional layers. But in addition to the arrangement in multi-layer designs, the first and second micromotif elements can also be arranged in the same layer.

The lateral dimensions of the first and, if applicable, the second micromotif elements and of the microfocusing elements are preferably below about 100 μm, preferably between about 5 μm and about 50 μm, particularly preferably between about 10 μm and about 35 μm.

The first and/or the second micromotif elements are preferably formed having a line width between about 1 μm and about 10 μm, preferably between about 1 μm and about 5 μm and/or having a pattern thickness between about between about 1 μm and about 10 μm, preferably between about 1 μm and about 5 μm. Here, the micromotif elements can, of course, also include a real regions and can exhibit both positive elements and negative elements.

In all embodiments, the first and/or, if applicable, the second micromotif elements are advantageously present in the form of microcharacters or micropatterns. It is understood that, to produce the moiré magnification effect, the micromotif elements must be largely identical. However, a slow, especially periodically modulated change of the appearance of the micromotif elements and thus also of the magnified images is likewise also within the scope of the present invention. Also, individual micromotif elements or a portion thereof can be furnished with additional pieces of information that do not appear in the magnified moiré image, but that can be used as additional authenticating marks.

In order to protect these against counterfeiting attacks, or to facilitate the further processing, for example, the production of negative lettering in applied metallic or color-shifting layers, the first and/or the second micromotif elements can be provided with an optically substantially isotropic overcoating.

The motif images and the arrangement of microfocusing elements are expediently arranged at opposing surfaces of an optical spacing layer. The spacing layer can comprise, for example, a plastic foil and/or a lacquer layer.

The microfocusing elements of the moiré magnification arrangement can be present as transmissive, refractive or diffractive lenses or as a hybrid form. They are preferably formed by non-cylindrical microlenses, especially by microlenses having a circular or polygonally delimited base area. The microlenses of the arrangement of microfocusing elements are advantageously formed by spherical or aspherical lenses.

In the security element are advantageously provided one or more optically substantially isotropic adhesive layers and/or one or more optically substantially isotropic adhesive-agent layers.

Furthermore, the security element can be furnished with one or more functional layers, especially with layers having visually and/or machine-perceptible security features. Here, contiguous or non-contiguous reflecting, high-index or color-shifting layers, for example, may be used, or also polarizing or phase-shifting layers, opaque or transparent conductive layers, magnetically soft or hard layers, or fluorescent or phosphorescent layers.

The present invention also includes a method for manufacturing a security element having a micro-optical moiré magnification arrangement in which a first motif image that consists of a planar periodic or at least locally periodic arrangement of a plurality of first micromotif elements that form a hidden piece of image information, and a planar periodic or at least locally periodic arrangement of a plurality of microfocusing elements, are arranged in such a way that the first micromotif elements are perceptible in magnification when viewed through the microfocusing elements. Here, the first micromotif elements are developed from nematic liquid crystal material in such a way that they form a phase-shifting layer for light from a specified wavelength range.

In an advantageous variant of the present invention, the first micromotif elements are formed by a nematic liquid crystal material layer thickness that is different in some regions. Here, the first micromotif elements are expediently embossed in a layer composed of nematic liquid crystal material that is applied to a substrate foil.

The nematic liquid crystal material can also be developed only in some regions and in the form of the first micromotif elements.

In a preferred development of the present invention, the first micromotif elements composed of nematic liquid crystal material are imprinted on a substrate foil.

The nematic liquid crystal material is advantageously applied on a substrate foil that is designed for aligning liquid crystals. Alternatively, the substrate foil can also be provided with an alignment layer for aligning liquid crystals. For example, a smooth PET foil of good surface quality can advantageously be used as the substrate foil. The substrate foil can also comprise multiple sub-layers, for example, an above-mentioned alignment layer. For example, a layer composed of a linear photopolymer, a finely patterned layer or a layer aligned by the application of shear forces may be used as the alignment layer. A suitable finely structured layer can be manufactured, for example, by embossing, etching or scoring.

In a preferred embodiment of the present invention, a substrate foil is provided whose surface exhibits an arrangement of elevations and depressions in the form of the desired motif image. To form the first micromotif elements, the depressions in the substrate foil are filled with nematic liquid crystal material. Without being bound to these explanations, presumably the geometry of the patterns is responsible for the nematic liquid crystal material also aligning in the depressions without additional alignment structures. Thus, preferably no alignment structures in the form of a foil provided with an alignment layer or a foil designed for aligning liquid crystals are provided in the depressions in the substrate foil for the alignment of the nematic liquid crystal material.

The thickness of the substrate foil is expediently between about 5 μm and about 50 μm, preferably between about 5 μm and about 25 μm.

In some embodiments, it is appropriate to use a substrate foil that is optically substantially isotropic for light from the predetermined wavelength range. For this, such a substrate foil can consist, for example, of cycloolefin copolymers or be formed by a combination of two or more differently stretched plastic foils.

Alternatively, the substrate foil exhibits, for light from the predetermined wavelength range, a defined optical anisotropy with a constant optical path difference across the expanse of the security element. Here, especially substrate foils having an optical path difference of $n*\lambda$, with n from the natural numbers, and especially having an optical path difference of $1*\lambda$, are preferred, since, as with an optically isotropic foil, the light polarization remains substantially unchanged upon passing through such a foil.

The nematic liquid crystal material is advantageously developed in such a layer thickness that the micromotif elements form, at least in sub-regions, a $\lambda/4$ layer or a $\lambda/2$ layer for light from the specified wavelength range.

According to a preferred embodiment of the present invention, the first micromotif elements, which produce the hidden piece of image information, are combined with at least one further motif image that consists of a planar periodic or at least locally periodic arrangement of a plurality of second micromotif elements that produce a visible piece of image information.

An inventive security paper for manufacturing security or value documents, such as banknotes, checks, identification cards, certificates or the like, is furnished with a security element of the kind described above. The security paper can especially comprise a carrier substrate composed of paper or plastic.

The present invention also includes a data carrier, especially a branded article, a value document, decorative article, such as packaging, postcards or the like, having a security element of the kind described above. Here, the security element can especially be arranged in a window region, that is, a transparent or gap region of the data carrier.

Further exemplary embodiments and advantages of the present invention are described below with reference to the drawings. To improve clarity, a depiction to scale and proportion is dispensed with in the drawings.

Figure 2:
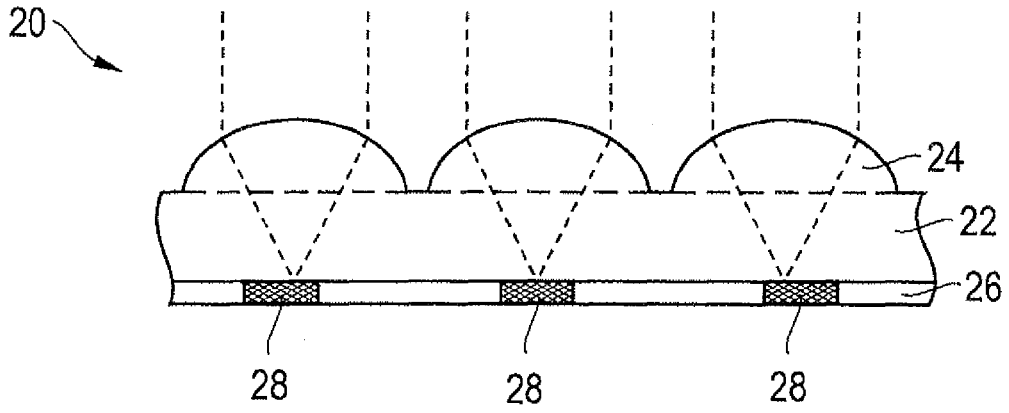
Figure 3A:
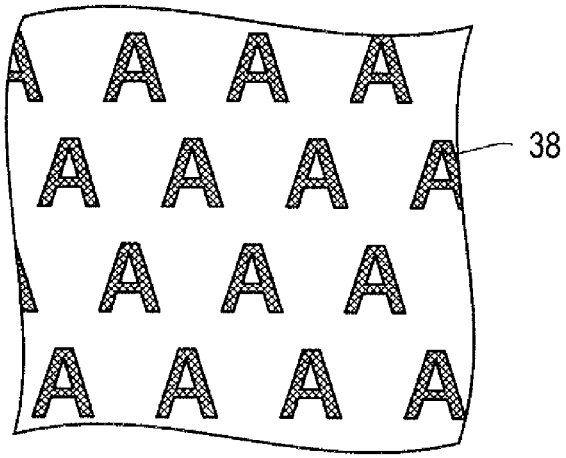
Figure 3B:
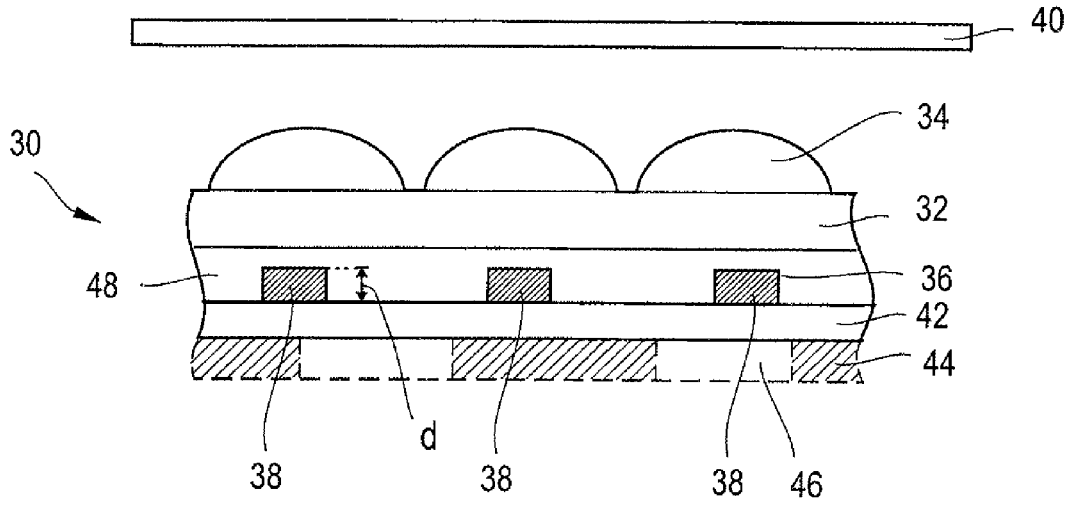
Figure 4:
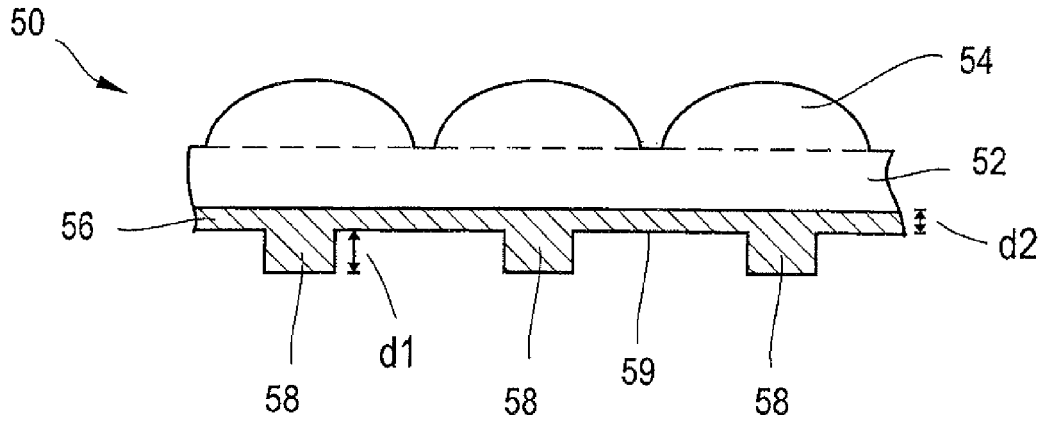
Figure 5:
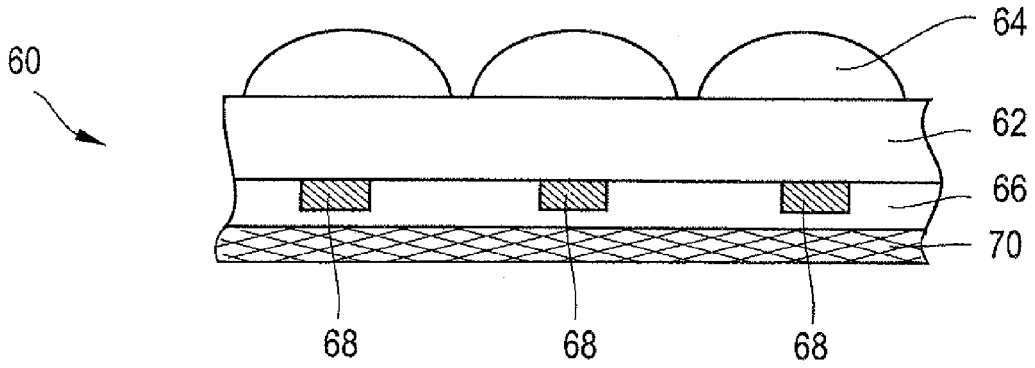
Figure 6A:
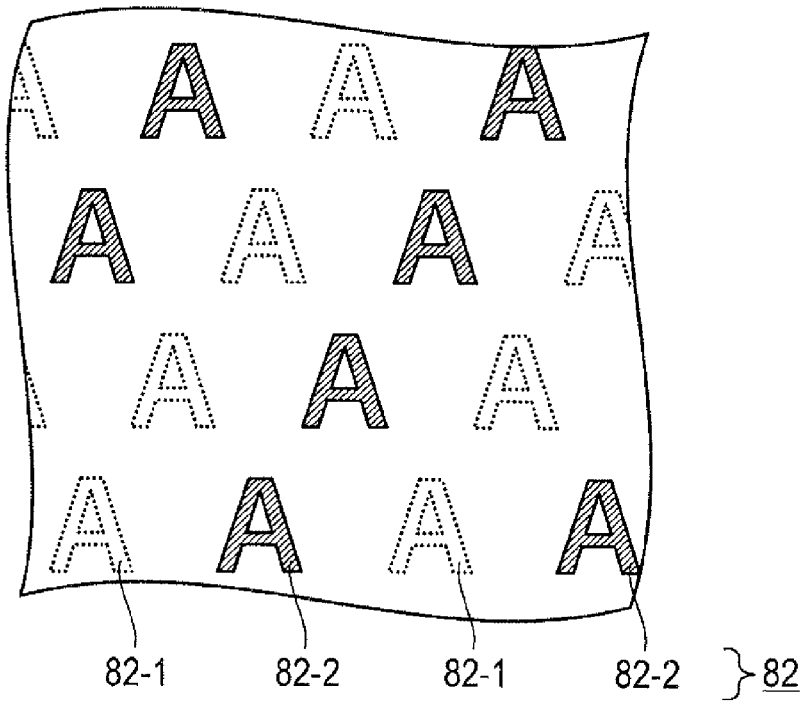
Figure 6B:
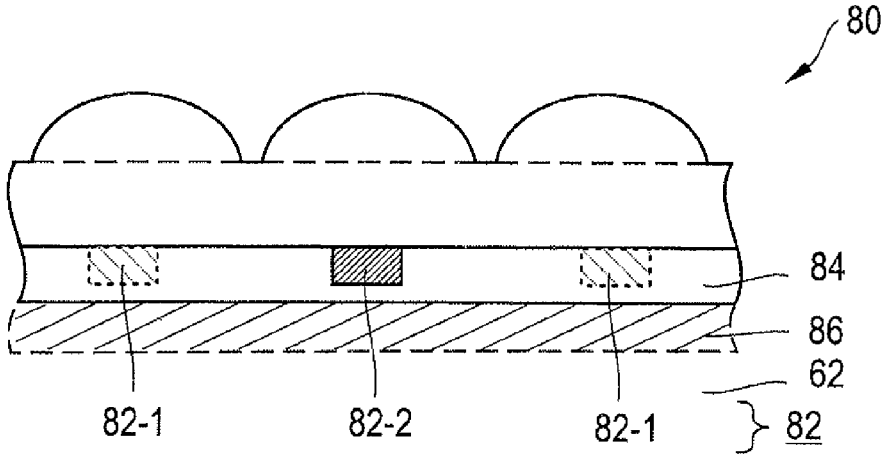
Figure 7A:
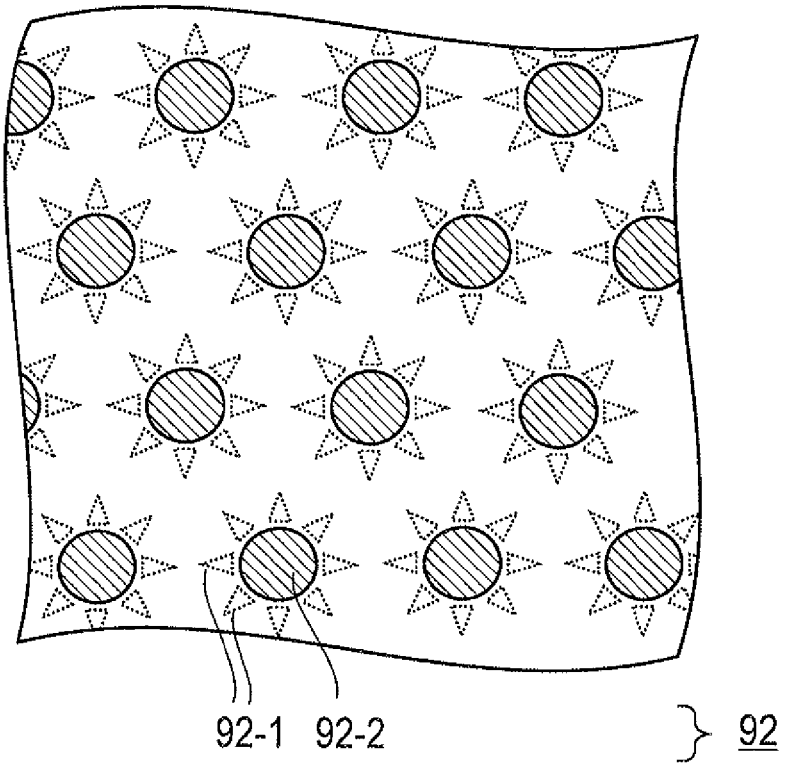
Figure 7B:
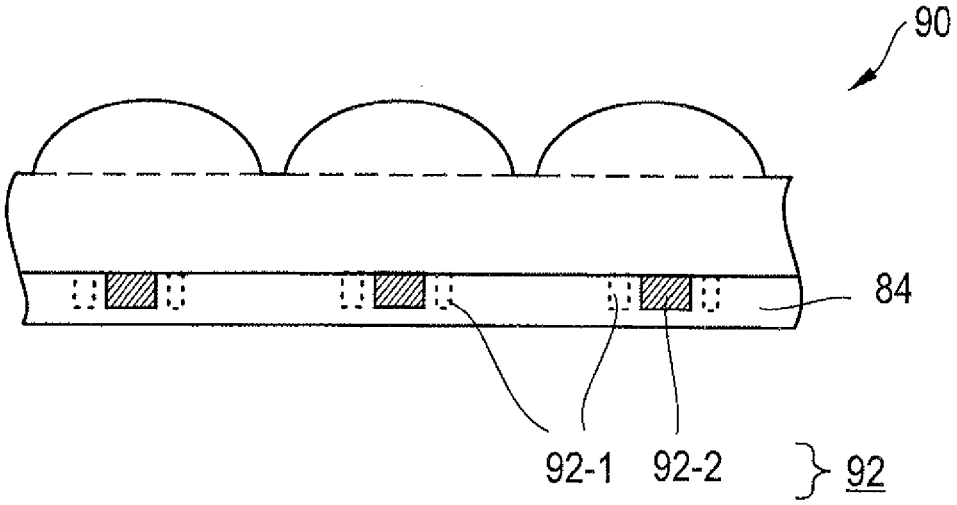

Shown are:

FIG. 1 a schematic diagram of a banknote having an embedded security thread and an affixed transfer element, FIG. 2 schematically, the layer structure of a security element according to the present invention, in cross section, FIG. 3 an inventive security element having a hidden motif image, with (a) showing a schematic top view and (b) showing a cross section through the security element and a circular polarizer for viewing the security element, FIG. 4 a security element having a hidden motif image according to a further exemplary embodiment of the present invention, in cross section, FIG. 5 a security element having a hidden motif image according to yet a further exemplary embodiment of the present invention, in cross section, FIG. 6 an inventive security element having one hidden and one visible motif image, with (a) showing a schematic top view of the motif images and (b) showing a cross section through the security element, and FIG. 7 an inventive security element having one hidden and one visible motif image that form moiré images that are associated in meaning, with (a) showing a schematic top view of the motif images and (b) a cross section through the security element.

The invention will now be explained using a security element for a banknote as an example. For this, FIG. 1 shows a schematic diagram of a banknote 10 that is provided with two security elements 12 and 16 according to exemplary embodiments of the present invention. Here, the first security element constitutes a security thread 12 that emerges in certain window regions 14 at the surface of the banknote 10, while it is embedded in the interior of the banknote 10 in the regions lying therebetween. The second security element is formed by an affixed transfer element 16 of arbitrary shape. The security element 16 can also be developed in the form of a security strip, a label or a cover foil that is arranged over a window region or a through opening in the banknote.

Both the security thread 12 and the transfer element 16 can include a moiré magnification arrangement having a hidden piece of image information according to an exemplary embodiment of the present invention. First, the fundamental functional principle of micro-optical moiré magnification arrangements according to the present invention will be briefly explained with reference to FIG. 2.

FIG. 2 shows schematically the layer structure of a security element 20 according to the present invention, in cross section, only the portions of the layer structure that are required to explain the functional principle being depicted.

The security element 20 includes an optical spacing layer 22 whose top is provided with a regular arrangement of microlenses 24. Here, the arrangement of the microlenses 24 forms, in some regions, a grid having, in each case, prechosen grid parameters, such as screen ruling, grid orientation and lattice symmetry. The lattice symmetry can be described by a two-dimensional Bravais lattice, with, for the sake of simplicity, a hexagonal symmetry being assumed for the following explanation, even if the Bravais lattice according to the present invention can exhibit a lower symmetry and thus a more general form.

On the bottom of the spacing layer 22, a motif layer 26 is arranged that includes a likewise grid-shaped arrangement of homogeneous micromotif elements 28. Also the arrangement of the micromotif elements 28 can be described by a two-dimensional Bravais lattice having a prechosen symmetry, a hexagonal lattice symmetry again being assumed for illustration. As indicated in FIG. 2 through the offset of the micromotif elements 28 with respect to the microlenses 24, the Bravais lattice of the micromotif elements 28 differs slightly in its symmetry and/or in the size of the grid parameters from the Bravais lattice of the microlenses 24 in order to produce the desired moiré magnification effect.

The spacing of adjacent microlenses 24 is preferably chosen to be as small as possible in order to ensure as high an areal coverage as possible and thus a high-contrast depiction. The spherically or aspherically designed microlenses 24 exhibit a diameter between 5 μm and 50 μm, preferably merely between 10 μm and 35 μm, and are thus not perceptible with the naked eye. Here, the grating period and the diameter of the micromotif elements 28 are on the same order of magnitude as those of the microlenses 24, so in the range from 5 μm to 50 μm, preferably from 10 μm to 35 μm, such that also the micromotif elements 28 themselves are not perceptible with the naked eye.

The optical thickness of the spacing layer 22 and the focal length of the microlenses 24 are coordinated with each other in such a way that the micromotif elements 28 are spaced approximately the lens focal length apart. Due to the slightly differing lattice parameters, the viewer sees, when viewing the security element 20 from above through the microlenses 24, a somewhat different sub-region of the micromotif elements 28 each time, such that the plurality of microlenses produces, overall, a magnified image of the micromotif elements 28. Here, the resulting moiré magnification depends on the relative difference between the grating parameters of the Bravais lattices used. If, for example, the grating periods of two hexagonal lattices differ by 1%, then a 100× moiré magnification results. For a more detailed description of the functional principle and for advantageous arrangements of the micromotif elements and the microlenses, reference is made to publications DE 10 2005 062 132 A1 and WO 2007/076952 A2, the disclosures of which are incorporated herein by reference.

In such moiré magnification arrangements, the micromotif elements are now formed, according to the present invention, from nematic liquid crystal material and form a phase-shifting layer for light from a specified wavelength range, such that the magnified moiré image is perceptible substantially only when the security element is viewed through a polarizer.

FIG. 3 shows an inventive security element having a hidden motif image that can be developed in the form of a security thread 30 for a banknote. Here, FIG. 3(*a*) shows a schematic top view of the motif image, and FIG. 3(*b*) a cross section through the security element and a circular polarizer for viewing the security element.

The security thread 30 exhibits, as the substrate, a transparent PET foil 32 of a thickness of about 25 μm. To a first surface of the PET foil 32 is applied, by means of embossing a UV-curing lacquer, a periodic arrangement of microlenses 34. To the opposing surface of the foil 32 was first applied a UV-curing lacquer 48 in which, by means of an embossing tool that is not shown, micropatterns 36 were produced that consist of an arrangement of elevations and depressions in the form of the desired motif image. The depressions are filled with nematic liquid crystal material to form the hidden micromotif elements 38. The nematic liquid crystal material aligns in the embossed depressions also without additional alignment structures. Without being bound to these explanations, presumably the geometry of the embossed patterns is responsible for this. In FIG. 3(*a*), the micromotif elements 38 that form the motif image are depicted only as simple letters "A" for illustration.

Due to the different refractive indices of the rod-shaped liquid crystals along the principal crystal axes, is it possible to use nematic liquid crystals to manufacture phase-shifting layers. Given an appropriately chosen layer thickness d, a λ/4 layer, for example, is obtained for a specified wavelength range. The layer thickness d of the layer composed of nematic liquid crystal material is specified in the exemplary embodiment through the appropriately chosen depth of the micropatterns 36.

The arrangement of the micromotif elements 38 is provided with a transparent overcoating 42 and, in this way, protected against counterfeiting attacks. To the overcoating 42 is applied a metallic reflector layer 44, composed for example of aluminum, chrome, silver or copper, that includes negative image elements in the form of non-coated sub-regions 46. Due to the overcoating 42, such coatings having gaps can be produced easily with a washing process, as is known, for example, from publication WO 99/13157 A1, since the overcoating 42 can compensate for the increased roughness of the micromotif elements 38 present in the depressions.

Without auxiliary means, the motif formed by the micromotif elements 38 that are present as a λ/4 layer is hardly perceptible since, in the regions of the micromotif elements, the security element reflects substantially the same amount of light as in the other regions, and the naked eye cannot perceive the linear polarization of the reflected light in the regions of the micromotif elements.

If, in contrast, the security element is viewed through a circular polarizer 40, then the motif image formed in the λ/4 layer of the micromotif elements 38 stands out in clear contrast, such that a moiré magnification effect is observed. Here, the micromotif elements 38 appear bright, and the regions of the metallic reflector layer 44 not covered by the micromotif elements 38, dark. A suitable circular polarizer 40 can be formed, for example, by a linear polarizer and a downstream λ/4 plate.

When the security element is viewed with a linear polarizer, the motif image formed in the λ/4 layer of the micromotif elements 38 can be made visible through a light/dark effect upon rotating the linear polarizer. While the brightness of the metallic reflector layer 44 remains substantially unchanged upon rotating the linear polarizer, the micromotif elements 38 indeed likewise appear bright in a first position of the polarizer, but become darker upon rotating the polarizer to a second position.

In an alternative embodiment that is not shown here, the security element can include, instead of the metallic reflector layer 44, a layer composed of cholesteric liquid crystal material. Here, the layer thickness of the micromotif elements 38 composed of nematic liquid crystal material is chosen in such a way that a λ/2 layer is obtained for the wavelength range in which the cholesteric liquid crystal layer selectively reflects. The security element further includes, at least in some regions, a dark background layer that forms an absorbing background. Here, the dark background layer can, itself, be present in the form of characters and/or patterns. In particular, said layer can be printed or produced by coloring a substrate or by the action of a laser beam on a substrate.

In the regions uncovered by the micromotif elements 38, the cholesteric liquid crystal layer reflects light having a prechosen circular polarization direction, for example left-circularly polarized light. In the regions of the micromotif elements 38 in which the two liquid crystal layers overlap, the security element reflects light having the opposite polarization direction, so right-circularly polarized light in the exemplary embodiment, since the incident unpolarized light is not influenced by the λ/2 layer of the micromotif elements 38, but the polarization direction of the left-circularly polarized light reflected by the cholesteric liquid crystal layer is just reversed in its polarization orientation by the λ/2 layer due to the optical path difference between the ordinary and the extraordinary ray.

Without auxiliary means, the motif formed by the micromotif elements 38 that are present as a λ/2 layer is hardly perceptible, since the security element reflects substantially the same amount of light in the covered areas as in the uncovered areas, and the naked eye cannot distinguish the circular polarization direction of the light.

If, in contrast, the security element 80 is viewed through a circular polarizer 40 that transmits only right-circularly polarized light, then the motif image formed in the λ/2 layer of the micromotif elements 38 stands out in clear contrast, such that a moiré magnification effect is observed. Here, the micromotif elements 38 appear bright, and the uncovered regions of the cholesteric liquid crystal layer dark. A reversed (negative) image impression results when a circular polarizer is used that transmits only left-circularly polarized light. As described above, the circular polarizer 40 can be formed, for example, by a linear polarizer having a downstream λ/4 plate.

In a development of this embodiment, also a color shift can be achieved upon viewing the circular polarizer. Here, the security element micromotif elements 38 that are developed as a λ/2 layer lie between two layers composed of cholesteric liquid crystal material that selectively reflect light from different wavelength ranges, but of the same circular polarization direction. For example, a—in the viewing direction—first cholesteric liquid crystal layer can reflect blue light in the vertical viewing direction and shorter-wave UV radiation in the acute-angled viewing direction, while a—in the viewing direction arranged below the λ/2 layer—second cholesteric liquid crystal layer can be developed in such a way that it reflects red light in the vertical viewing direction and shorter-wave green light in the acute-angled viewing direction. When viewed with a circular polarizer, it is now possible to observe, only in the regions formed by the λ/2 layer of the micromotif elements 38 and depending on the transmission properties of the circular polarizer, which transmits either only right- or only left-circularly polarized light, and on the polarization properties of the cholesteric liquid crystal layers when the security element is tilted, certain color-shift effects: from blue to ultraviolet (motif image disappears upon tilting) or from red to green (motif image changes color). Viewed without auxiliary means, the security element uniformly displays a color-shift effect from magenta to green. The motif image formed in the λ/2 layer of the micromotif elements 38 is hardly perceptible here.

Alternatively, the dark background layer, which is essential for the perceptibility of the described color or polarization effects, can also be provided by a separate display element and formed, for example, by a commercially available printing ink imprinted on one side of the banknote. Only when the banknote is folded such that the security element, in this case expediently embodied as a see-through security element, comes to rest on the display element can the provided color and/or polarization effects be perceived.

The security element 50, shown in FIG. 4 according to a further exemplary embodiment of the present invention, exhibits a hidden motif image in which the micromotif elements are formed by a regionally different thickness of a layer composed of nematic liquid crystal material. Also the security element 50 can be a security thread or a cover foil for banknotes.

To the opposing side of a substrate 52 that is provided with a periodic arrangement of microlenses 54, for example a PET foil, a layer 56 composed of nematic liquid crystal material was first applied, preferably imprinted, in which an arrangement of elevations and depressions was embossed in the form of the desired motif image. Preferably, a foil designed to align liquid crystals is used as the substrate. Alternatively, the substrate 52 can also be provided with an alignment layer for aligning liquid crystals. The imprint in the layer 56 composed of nematic liquid crystal material can be done, for example, in the intaglio printing, inkjet, flexographic printing, offset printing or multi-roll printing method. Here, with printing methods that require a low viscosity, a suitable thinning can be done with solvents. With printing methods that require a high viscosity, such as the offset printing method or the multi-roll printing method, the viscosity of the liquid crystal material can occur, for example, through application of the liquid crystal material from the melt.

Here, in the regions of the layer 56 that form micromotif elements 58, the layer thickness $d_1$ is chosen in such a way that, for a specified wavelength range, a λ/4 or a λ/2 layer is obtained. In the exemplary embodiment, the layer thickness $d_2$ of the regions 59 lying therebetween is below about 0.5 μm, preferably below about 0.3 μm. The optical effect of these regions 59 of the nematic liquid crystal layer 56 can be neglected due to their small layer thickness $d_2$. In nematic liquid crystal layers, a layer thickness on the order of about 0.5 μm to about 3 μm is typically required in order to achieve a clear phase-shifting effect.

According to an alternative embodiment, the nematic liquid crystal layer 56 can also be imprinted in the various sub-regions 58, 59 in the form of the desired motif image with different layer thicknesses $d_1$ and $d_2$, for example in multiple printing operations.

FIG. 5 shows a security element according to the present invention having a hidden motif image that can be developed in the form of a security thread or, as in the exemplary embodiment, in the form of a cover foil 60 for a banknote having a hole.

The cover foil 60 exhibits, as the substrate, a transparent PET foil 62 having a thickness of about 20 μm and on whose one surface a periodic arrangement of microlenses 64 is applied. The opposing surface of the substrate foil 62 is first pretreated for a good anchoring of the nematic liquid crystal material, for example by means of an adhesion-promoting corona method in which the process atmosphere can differ from air. A motif image composed of micromotif elements 68 is then applied to the pretreated surface.

For the application of the micromotif elements 68, a die mold, not shown here, whose surface exhibits an arrangement of elevations and depressions in the form of the desired micropattern is used. The depressions in the die mold are filled with a curable nematic liquid crystal material, for example in the form of a liquid crystal melt, and the surface of the die mold then brought into contact with the surface-treated substrate foil 62, with the nematic liquid crystal material that is in contact with the substrate foil being cured in the depressions in the die mold.

Finally, the surface of the die mold is removed from the substrate foil 62 again such that the cured nematic liquid crystal material that, in the form of the micromotif elements 68, is joined with the substrate foil can be pulled out of the depressions in the die mold or embossing mold. Here, the depth of the depressions in the die mold is selected in such a way that the micromotif elements 68 produced therewith form, in the exemplary embodiment, a λ/2 layer for a specified wavelength range. Further details on such a printing process can be found in publication WO 2008/00350 A1, whose disclosure is incorporated in the present application by reference.

The depressions in the die mold or embossing mold can exhibit an alignment-promoting pattern to align the nematic liquid crystal material. Without being bound to these explanations, alternatively, or in addition, also the geometry of the depressions in the die or embossing mold can be responsible for the alignment of the nematic liquid crystal material. In addition, shear forces such as occur when filling the depressions have an impact on the alignment of the nematic liquid crystal material.

It is understood that the micromotif elements 68 can be formed both by the depressions and by the elevations in the die mold. In the first case, micromotif elements in a transparent environment are obtained that are hidden on the substrate foil 62 and perceptible only with the aid of a polarizer, in the latter case, transparent micromotif elements in an environment that is perceptible only with the aid of a polarizer. In both cases, the information content of the applied micromotif elements is identical.

The arrangement of the micromotif elements 68 is embedded in a transparent overcoating 66 and, in this way, protected against counterfeiting attacks, with the transparent overcoating forming an optically substantially isotropic layer. To the transparent overcoating is applied, in the exemplary embodiment, a linear polarizer 70.

If further opaque functional layers are dispensed with, then, upon application of the cover foil 60 in register with the banknote paper, a moiré magnification effect that is observable in transmission and with the aid of, for example, a linear polarizer is created in the finished banknote. In this way, the viewer perceives, upon rotating a linear polarizer held over the cover foil 60, the motif image formed in the λ/2 layer of the micromotif elements 68 in the form of a light/dark effect. However, such an effect is dependent on the choice of the substrate foil 62 through which the viewer looks at the micromotif elements 68. In an embodiment in which both the microlenses 64 and the micromotif elements 68, including the linear polarizer 70, are arranged on the same side of the substrate foil 62, it is also possible to observe the effect independently of the optical properties of the substrate foil.

In an alternative embodiment, the micromotif elements 68 can form, for a specified wavelength range, instead of a λ/2 layer, a phase-shifting layer having a constant optical path difference not equal to n*λ, with n from the natural numbers. Also in this embodiment, the viewer perceives, upon rotating a linear polarizer held over the cover foil 60, the motif image formed by the micromotif elements 68 in the form of a light/dark effect.

If the security element is to be provided with, instead of the linear polarizer 70, a metallic reflector layer that optionally exhibits gaps, then here, too, it is advantageous to provide the arrangement of the micromotif elements with a transparent overcoating 66. Through the overcoating 66, such coatings having gaps can easily be produced with a washing process, as is known, for example, from publication WO 99/13157 A1, since the overcoating compensates for the local roughness that is sharply increased by the applied micromotif elements 68. Furthermore, in this way it is avoided that ink remains in the depressions between the micromotif elements upon washing out the washable ink.

The security element 80 according to a further exemplary embodiment of the present invention, shown in FIG. 6, exhibits, in addition to a hidden motif image, also one that is visible with the naked eye. Also the security element 80 can be a security thread or a cover foil for banknotes.

Micromotif elements having hidden and visible pieces of information can be produced in multiple printing operations, for example with multiple die molds or embossing molds filled with nematic liquid crystal material or colored lacquer, as are described in connection with FIG. 5. The micromotif elements need not all be present in the same layer, it is also possible to realize multi-layer embodiments. If arrangements of micromotif elements having hidden and visible pieces of image information are produced in this way, the various arrangements generally need not be in register with one another, since for the moiré effect, the relative orientation of the microlens arrangement and the respective micromotif element arrangement is decisive. However, depending on the application, also an exact register of the micromotif element arrangements with one another can be advantageous.

The arrangement of the micromotif elements 82 shown in FIG. 6(*a*) in top view includes micromotif elements 82-1 that form a hidden piece of information and whose contour is depicted in dots in the figure, and micromotif elements 82-2, filled with hatching, that form a visible piece of information. For illustration, both the micromotif elements 82-1 and the micromotif elements 82-2 in FIG. 6(*a*) are depicted only as simple letters "A".

It is possible to produce the different micromotif elements on a substrate foil, in the exemplary embodiment an optically isotropic substrate foil, for example with the aid of two dies that are filled with nematic liquid crystal material to form the hidden micromotif elements 82-1 and with colored lacquer to form the visible micromotif elements 82-2. It is understood that the micromotif elements 82-1 and 82-2 can also be embodied in the form of different microcharacters or micropatterns.

The arrangement of the micromotif elements 82 is embedded in a transparent overcoating 84 and, in this way, protected against counterfeiting attacks. If desired, further layers can be applied, for example a metallic reflector layer 86, depicted with a dotted line in FIG. 6(*b*), that can include negative image elements in the form of non-coated sub-regions. Alternatively, the security element 80 can also include, instead of the metallic reflector layer 86, a layer composed of cholesteric liquid crystal material or a linear polarizer.

The magnified moiré image of the micromotif elements 82-2 that form a visible piece of information is already clearly perceptible for a viewer without auxiliary means. Since the security element 80 reflects substantially the same amount of light in the regions covered with the nematic liquid crystal material as the uncovered regions, and the naked eye cannot distinguish the polarization of the light, the motif formed by the micromotif elements 82-1, in contrast, is hardly perceptible without auxiliary means. If, however, the security element is viewed through a circular polarizer, then the motif image formed by the micromotif elements 82-1, for example in a λ/4 or λ/2 layer, stands out in clear contrast such that a moiré magnification effect is observed also for the micromotif elements 82-1.

Here, if the hidden micromotif elements 82-1 form a λ/4 layer, then these appear bright when viewed with a circular polarizer, the uncovered regions of the metallic reflector layer, in contrast, dark, as is described, for example, in connection with FIG. 3. Thus, when viewed with a circular polarizer, the viewer perceives especially the previously hidden micromotif elements 82-1 moiré magnified, while the micromotif elements 82-2 are now present against a dark background and, depending on the color of the micromotif elements, are, if applicable, no longer clearly perceptible, or they even completely disappear. If an optically anisotropic substrate foil is used, the above-described effects can reverse, that is, the hidden micromotif elements 82-1 appear dark when viewed with a circular polarizer, while the uncovered regions of the metallic reflector layer appear bright.

FIG. 7 shows a further embodiment of an inventive security element 90 having a hidden and a visible motif image. In the exemplary embodiment, adjacent, differently embodied micromotif elements 92-1, 92-2 are applied that form moiré images that are associated in meaning.

The micromotif elements 92-1 that form a hidden piece of information and are depicted with dots radially surround the micromotif elements 92-2 that are filled with hatching and that form a visible piece of information. When the security element 90 is viewed with a suitable polarizer, the motif image (circular area) that is perceptible without auxiliary means and formed by the micromotif elements 92-2 is supplemented by the radial arrangement of the micromotif elements 92-1 to form a complete image (sun).

It is understood that the hidden and visible micromotif elements can be present not only together on the same lattice sites, but also separately in different regions of the security element. For example, a sub-region of a security element can be provided with only hidden micromotif elements, another sub-region with only visible micromotif elements. If such a security element is viewed with a suitable polarizer, then in addition to the motif image that is already visible, for example colored fish arranged in an upper region of the security element, also the hidden micromotif elements appear moiré magnified, for example in a lower region of the security element as wavy lines. Thus, with the aid of the polarizer, it is possible to supplement a motif image that is already perceptible without auxiliary means to form a (whole) complete image.

Furthermore also the security element in FIG. 7 can be provided with additional layers, such as a metallic reflector layer, a layer composed of cholesteric liquid crystal material or a linear polarizer, as already described in connection with FIG. 6. Alternatively, these layers can also be provided by an additional display element, for example at a different location of a value document that is provided with the security element.

The invention claimed is:

1. A security element comprising:

a micro-optical moiré magnification arrangement having:

a first motif layer including a first motif image formed by a planar arrangement of a plurality of first micromotif elements that produce a hidden piece of image information, the first micromotif elements being arranged (i) periodically in a plane or (ii) at least locally periodically in a plane, and a planar arrangement of a plurality of microfocusing elements for the viewing, in a magnified moiré image, of the first micromotif elements of the first motif image, the microfocusing elements being arranged (i) periodically in a plane or (ii) at least locally periodically in a plane, the first micromotif elements being formed from nematic liquid crystal material and forming a phase-shifting layer providing a constant phase-shift for light from a specified wavelength range such that the hidden piece of image information is substantially imperceptible to an unaided naked eye of a viewer, and the magnified moiré image being perceptible substantially only upon viewing the security element through a polarizer such that the hidden piece of image information is perceptible, and the first micromotif elements being formed in different regions of the first motif layer by a different thickness of a layer composed of the nematic liquid crystal material.

2. The security element according to claim 1, characterized in that the nematic liquid crystal material is present only in some regions of the first motif image layer at the location of the first micromotif elements.

3. The security element according to claim 1, characterized in that the first micromotif elements form, at least in some of the regions of the motif layer, a λ/4 layer for light from the specified wavelength range.

4. The security element according to claim 1, further comprising a metallic reflector.

5. The security element according to claim 1, characterized in that the first micromotif elements form, at least in some of the regions of the motif layer, a λ/2 layer for light from the specified wavelength range.

6. The security element according to claim 1, further having at least one of a linear polarizer and one or more layers composed of cholesteric liquid crystal material.

7. The security element according to claim 1, characterized in that the nematic liquid crystal material additionally exhibits a fluorescence functionality, or in that a further nematic liquid crystal material that exhibits a fluorescence functionality is added to the nematic liquid crystal material.

8. The security element according to claim 1, characterized in that the first motif image is combined with at least one further motif image that includes an arrangement of a plurality of second micromotif elements that produce a visible piece of image information, the plurality of second micromotif elements being arranged (i) periodically in a plane or (ii) at least locally periodically in a plane.

9. The security element according to claim 1, characterized in that the arrangement of first micromotif elements, and the arrangement of microfocusing elements each form, at least locally, a two-dimensional Bravais lattice.

10. The security element according to claim 9, characterized in that the arrangement of first micromotif elements and the arrangement of second micromotif elements are identical in their grating periods and grating orientations, each lattice site of the arrangement of first micromotif elements being occupied with at least one of a first motif element and a second motif element.

11. The security element according to claim 10, characterized in that a) each lattice site is occupied by either a first micromotif element or a second micromotif element, such that the first and the second micromotif elements are arranged alternatingly, or b) each lattice site is occupied by a first motif element and a second motif element, and the first and second micromotif elements are, at least in part, present next to one another.

12. The security element according to claim 9, characterized in that the arrangement of first micromotif elements and the arrangement of second micromotif elements differ in at least one of their grating periods and grating orientations.

13. The security element according to claim 8, characterized in that the arrangement of first micromotif elements and the arrangement of second micromotif elements are arranged in different layers.

14. The security element according to claim 8, characterized in that the arrangement of first micromotif elements and the arrangement of second micromotif elements are arranged in the same layer.

15. The security element according to claim 8, characterized in that the first and the second micromotif elements form moiré images that are associated in meaning.

16. A security paper for manufacturing security or value documents, such as banknotes, checks, identification cards, certificates, a data carrier, a branded article, a value document, or a decorative article, having the security element according to claim 1.

17. The security element according to claim 9, characterized in that at least one of the arrangement of first micromotif elements and the arrangement of microfocusing elements form a Bravais lattice having symmetry of a parallelogram grating.

18. The security element according to claim 9, characterized in that the first micromotif elements, which produce the hidden piece of image information, are combined with at least one further motif image that consists of a planar periodic or at least locally periodic arrangement of a plurality of second micromotif elements that produce a visible piece of image information, and wherein the arrangement of first micromotif elements, the arrangement of microfocusing elements and the arrangement of second micromotif elements each form, at least locally, a two-dimensional Bravais lattice.

19. The security element according to claim 18, characterized in that at least one of the arrangement of first micromotif elements, the arrangement of microfocusing elements, and the arrangement of second micromotif elements form a Bravais lattice having the symmetry of a parallelogram grating.

20. The security element according to claim 1, the security element being located on one of a security paper, value document, identification document, and branded article.

* * * * *